United States Patent [19]

Schlie et al.

[11] 4,306,574

[45] Dec. 22, 1981

[54] MACHINE FOR SHREDDING TOBACCO OR THE LIKE

[75] Inventors: Gerhard Schlie, Hamburg; Uwe Elsner, Dassendorf; Werner Komossa, Börnsen; Fritz Selonke, Hamburg, all of Fed. Rep. of Germany

[73] Assignee: Hauni-Werke Körber & Co. KG, Hamburg, Fed. Rep. of Germany

[21] Appl. No.: 168,279

[22] Filed: Jul. 10, 1980

[30] Foreign Application Priority Data

Jul. 13, 1979 [DE] Fed. Rep. of Germany ..... 2928268

[51] Int. Cl.[3] ..... A24B 3/00; A24B 3/18

[52] U.S. Cl. ..... 131/111; 131/109 AB

[58] Field of Search ..... 131/108-110, 131/111-116, 145

[56] References Cited

U.S. PATENT DOCUMENTS 4,149,547 4/1979 Komossa et al. ..... 131/109 AB 4,254,781 3/1981 Thiele et al. ..... 131/111

*Primary Examiner*—V. Millin

*Attorney, Agent, or Firm*—Peter K. Kontler

[57] ABSTRACT

A machine for shredding tobacco wherein the rear portion of the upper reach of the lower chain conveyor of the conveyor system which converts a continuous stream of tobacco particles into a continuous cake is located below the open lower end of an upright duct serving to deliver tobacco to the conveyor system. The rear wall of the duct is oscillated by an orbiting eccentric pin through the medium of a rod, a lever and a link, the latter being rigidly connected with the upper portion of the rear wall and being pivotable about the axis of a horizontal shaft disposed substantially centrally and transversely of the upper end of the duct so that a vertical plane which includes such axis intersects the upper reach of the lower chain conveyor in front of the forwardly curved spade-like lower portion of the rear wall. The rear wall performs an oscillatory movement of such nature that its upper portion moves substantially up and down to intermittently tamp the admitted particles of tobacco into the lower portion of the duct and that its lower portion performs forward and return strokes along a substantially horizontal path to thereby change the direction of movement of tobacco particles which issue from the lower end of the duct and to advance such particles along the rear portion of the upper reach of the lower conveyor and into the forwardly converging path between such upper reach and the lower reach of the upper chain conveyor of the conveyor system. This ensures that the flow of tobacco particles in the duct is not interrupted and that the cake which develops between the two chain conveyors is free of voids.

10 Claims, 1 Drawing Figure

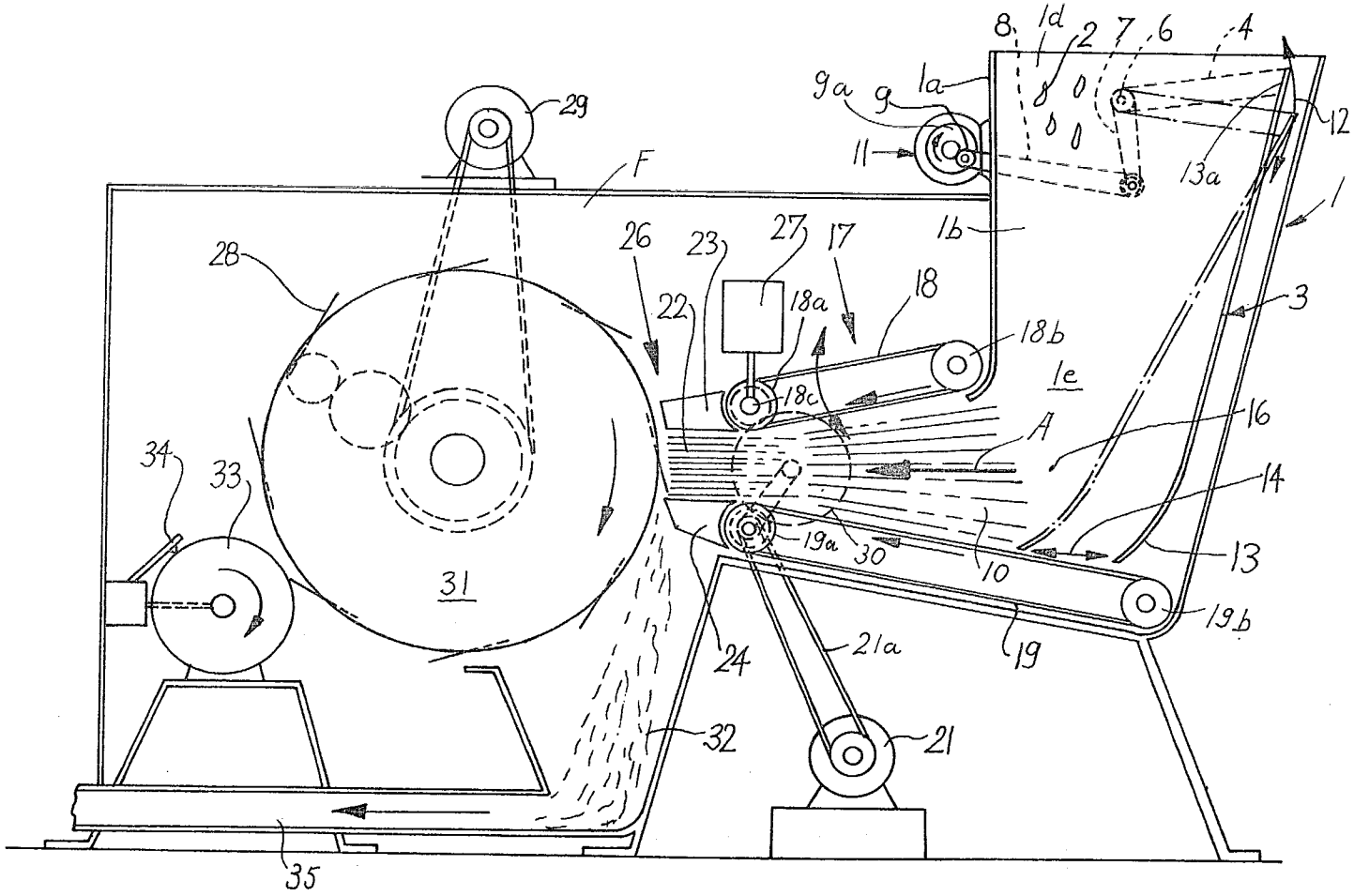
1
1a
1b
1d
1e
2
3
4
6
7
8
9
9a
10
11
12
13
13a
14
16
17
18
18a
18b
18c
19
19a
19b
21
21a
22
23
24
26
27
28
29
30
31
32
33
34
35
A
F

MACHINE FOR SHREDDING TOBACCO OR THE LIKE

BACKGROUND OF THE INVENTION

The present invention relates to comminuting or shredding machines in general, and more particularly to improvements in machines for cutting or shredding tobacco or analogous fibrous materials. Still more particularly, the invention relates to improvements in machines for cutting tobacco or the like wherein two convergent conveyors convert a stream of fibrous material into a continuous cake which is caused to move lengthwise and whose leader is severed by one or more orbiting knives so that the cake yields particles in the form of shreds or the like.

The term "tobacco" is intended to embrace natural tobacco (including leaves, tobacco leaf laminae and/or ribs), reconstituted tobacco as well as tobacco substitutes. As a rule, such material is fed into an upright duct at the rear end of a conveyor system which serves to convert the particles into a cake and delivers the leader of the cake into the range of one or more driven knives. The supply of tobacco which descends in the duct is accepted by the rear portion of the upper reach of an endless chain or belt conveyor which constitutes one component of the aforementioned conveyor system and cooperates with the lower reach of a second chain or belt conveyor to gradually compact the fibrous material while simultaneously transporting the resulting cake toward and through a mouthpiece which is installed immediately in front of the severing or shredding station. In order to ensure continuous descent of fibrous material in the duct, the latter comprises or confines a mobile rear wall which is oscillated or performs analogous recurrent movements so as to prevent bridging of particles in the duct before the particles reach and are entrained by the conveyor system. The latter defines a substantially or nearly horizontal forwardly converging path for the cake.

It is desirable and advantageous to subject the particles of fibrous material in the region of the conveyor system to a constant and predictable compacting action. Such treatment guarantees the formation of satisfactory shreds and prolongs the useful life of the knife or knives at the shredding station. Constant and predictable compacting action depends, at least to a certain extent, on the height of the supply of fibrous material in the duct. Thus, if the height of the supply is constant, and if the consistency of material in the duct is also constant, the machine is much more likely to produce a cake of predictable characteristics.

In most tobacco cutting machines, the rear wall of the duct behind the path which is defined by the conveyor system simply pivots back and forth about a fixed axis. Reference may be had, for example, to U.S. Pat. No. 2,275,103. It has been found that a rear wall which is mounted and moves in the just described manner is incapable of invariably preventing the development of voids in the supply of fibrous material in the interior of the duct and/or in the tobacco cake. Moreover, such rear wall cannot always prevent or reduce the probability of or eliminate bridging of fibrous material in the duct. The likelihood of unsatisfactory progress of fibrous material toward the severing station is especially pronounced in the critical region where the direction of travel of particles is changed from vertical to horizontal, i.e., in the region of the lower end of the duct at the rear end of the aforementioned path. Cavities in the cake of fibrous material between the conveyors of the conveyor system necessarily entail the development of zones wherein the density of the cake is less than the desired optimum density. This, in turn, exerts a highly undesirable influence upon the quality of shreds as well as on the useful life of the severing instrumentalities.

OBJECTS AND SUMMARY OF THE INVENTION

An object of the invention is to provide a machine for cutting tobacco or analogous fibrous material with novel and improved means for enhancing the quality of the accumulation of material which is advanced into the range of severing instrumentalities.

Another object of the invention is to provide the machine with novel and improved means for advancing fragments of tobacco or other fibrous material into the range of the conveyor system which serves to compact and convert the fragments into a cake which is ready for subdivision into shreds or the like.

A further object of the invention is to provide novel and improved means for stabilizing the conditions in the region where a mass of fibrous material is caused to change the direction of its movement on the way toward the severing station.

An additional object of the invention is to provide novel and improved means for agitating and advancing a continuous supply of loose or low-density tobacco shreds into the range of compacting and conveying means.

Another object of the invention is to provide a machine which can produce a continuous cake of tobacco or like fibrous material so that the cake is free of voids and its density is constant or deviates only negligibly from a desirable optimum value.

A further object of the invention is to provide a novel and improved arrangement for supplying tobacco or similar fibrous material into the range of conveyors which transport the material to the severing station, the arrangement being such that it can be incorporated in many types of existing cutting machines as a superior substitute for heretofore known and used arrangements.

Another object of the invention is to provide novel and improved means for agitating certain component parts of a machine which is used to shred natural, reconstituted and/or substitute tobacco.

The invention is embodied in a machine for cutting tobacco or similar fibrous material. The machine comprises a conveyor system defining an elongated substantially horizontal forwardly converging path for the transport of fibrous material in a predetermined direction (namely, from the wider rear end toward the narrower front or discharge end of such path) and including a portion extending rearwardly of and beyond the path (this portion may constitute the rear section of the upper reach of an endless chain or belt conveyor which is adjacent to the underside of the aforementioned elongated path), a substantially upright duct having an open upper portion for admission of fibrous material into the interior of the duct and an open lower portion disposed above and arranged to discharge fibrous material onto the aforementioned portion of the conveyor system, a mobile rear wall which forms part of or is installed in the duct and has an upper portion in the region of the open upper portion and a lower portion (which preferably curves forwardly, as considered in the aforementioned direction, and resembles a spade) in the region of the open lower portion of the duct, and means for oscillating the rear wall with a substantially vertical component of movement in the region of the open upper portion and with a substantially horizontal component of movement in the region of the open lower portion of the duct so that the upper portion of the rear wall intermittently advances fibrous material from the upper toward the lower portion of the duct and the lower portion of the rear wall intermittently advances fibrous material from the open lower portion of the duct, along the aforementioned portion of the conveyor system and into the elongated path. The material is thereby tamped in the lower portion of the duct and such tamped material is forced into the rear portion of the path wherein the conveyor system converts the admitted material into a continuous cake which is free of voids and is of constant or nearly constant density so as to be readily convertible into shreds of predictable size and shape by one or more knives which move across the leader of the cake at the discharge end of the path.

The oscillating means preferably comprises a horizontal shaft or an analogous pivot member which is disposed in front of the upper portion of the rear wall, as considered in the aforementioned direction, and means for coupling the upper portion of the rear wall of the duct to the pivot member. The axis of the pivot member is preferably located in a vertical plane which intersects the aforementioned portion of the conveyor system in front of the lower portion of the rear wall. The means for coupling the pivot member to the upper portion of the rear wall may comprise one or more links which are pivotable about the axis of the pivot member and are rigid with the upper portion of the rear wall. The pivot member is preferably disposed substantially centrally of the upper portion of the duct, as considered in the aforementioned direction (i.e., substantially midway between the upper portions of the front and rear walls of the duct).

The novel features which are considered as characteristic of the invention are set forth in particular in the appended claims. The improved machine itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

The single FIGURE of the drawing is a somewhat schematic partly elevational and partly longitudinal vertical sectional view of a cutting machine which embodies the invention, the rear wall of the material supplying duct being shown in two different positions which are respectively denoted by solid and phantom lines.

DESCRIPTION OF THE PREFERRED EMBODIMENTS

The cutting machine which is shown in the drawing resembles a tobacco cutter of the type known as KT (produced and sold by the assignee of the present application). The machine comprises an upright or nearly upright duct 1 which receives fragments of fibrous material 2 (hereinafter referred to as tobacco) from a suitable source, not shown. Reference may be had to commonly owned U.S. Pat. No. 4,037,712 granted July 26, 1977 to Waldemer Wochnowski. The duct 1 comprises a rear wall 3 which is mounted and driven in accordance with a feature of the present invention. The mounting of the rear wall 3 and of the stationary (or preferably stationary) front wall 1*a* of the duct 1 is such that the width of the duct decreases in a downward direction, namely, toward the rear portion of the upper reach of an endless chain or belt conveyor 19 which forms part of a material compacting and transporting conveyor system 17.

The means for imparting recurrent movements to the rear wall 3 of the duct 1 comprises a variable-speed electric motor 11 or an analogous prime mover having a rotary output element 9*a* for an eccentric pin 9 which is coupled to one end portion of an elongated connecting rod 8. The other end portion of the connecting rod 8 is articulately connected to the free end of a lever 7 which is rigid with a coupling link 4 and is pivotable about the horizontal axis of a transverse pivot member or shaft 6 mounted in the side walls 1*b* (only one shown) of the duct 1. The shaft 6 is disposed in or at the open upper end or the inlet 1*d* of the duct 1 substantially midway between the upper portions of the front and rear walls 1*a*, 3, i.e., in front of the rear wall. During each revolution of the output element 9*a*, the linkage including the rod 8, lever 7 and link 4 causes the rear wall 3 to perform a movement from the retracted position (indicated by solid lines) to the extended or foremost position (indicated by phantom lines) and back to the retracted position. The upper portion 13*a* of the wall 3 is rigid with the rear end portion of the link 4.

When the motor 11 is on, the upper portion 13*a* of the rear wall 3 moves substantially in the directions indicated by a double-headed arrow 12, and the lower portion 13 of the rear wall 3 moves substantially in directions indicated by a double-headed arrow 14. It will be noted that the upper portion 13*a* of the rear wall 3 performs a predominantly vertical movement or a movement having a predominantly vertical component. On the other hand, the lower portion 13 of the rear wall 3 performs a movement having a predominantly horizontal component, namely, a component which is substantially parallel to the direction (arrow A) of movement of the upper reach of the lower chain conveyor 19. The lower portion 13 of the rear wall 3 preferably resembles a spade in order to promote its ability to advance fragments 2 of tobacco from the open lower end 1*e* of the duct 1 in the direction changing zone 16 above the rear portion of the upper reach of the conveyor 19.

The motor 11 orbits the eccentric pin 9 at a given frequency so that the rear wall 3 oscillates at the same frequency and intermittently feeds fragments 2 of tobacco into the path 10 between the upper reach of the conveyor 19 and the lower reach of the upper chain or belt conveyor 18 of the conveyor system 17. The just mentioned reaches of the conveyors 18 and 19 converge in the direction of the arrow A, namely, toward a severing or shredding station accommodating a mouthpiece 26 including a mobile upper portion 23 and a stationary lower portion 24. The cake which is formed between the conveyors 18 and 19 is shown at 22; the leader of this cake passes through the mouthpiece 26 at the severing or shredding station and is severed by successive knives 28 on a rotary cylindrical drum-shaped holder 31 which is driven by a prime mover 29. Such prime mover can be mounted on top of the machine frame F. The cutting edges of the knives 28 are sharpened by a grinding wheel 33 which is driven by a motor, not shown, to rotate in the direction of the arrow and whose working or active surface is treated by a dressing tool 34. The lower portion 24 of the mouthpiece 26 cooperates with and constitutes a stationary counterknife for the orbiting knives 28.

The machine frame F further supports a discrete prime mover 21 for the conveyors 18 and 19. The pulleys or sprocket wheels 19*a*, 19*b* of the lower conveyor 19 are rotatable in the frame F about fixed axes and the front pulley or sprocket wheel 19*a* is driven by a belt or chain transmission 21*a* which receives motion from the output element of the prime mover 21. The conveyor 18 includes pulleys or sprocket wheels 18*a*, 18*b* the latter of which is rotatable about a fixed axis. The front sprocket wheel 18*a* has a shaft 18*c* which is mounted in a pivotable carriage (not shown) and is free to move along an arc having its center of curvature on the axis of the pulley or sprocket wheel 18*b*. The shaft 18*c* is biased downwardly by a yieldable biasing device 27, such as a dashpot or the like. This ensures that the upper chain or belt conveyor 18 can pivot about the axis of the pulley or sprocket wheel 18*b* in response to entry of a hard object into the path between the conveyors 18 and 19. The means for transmitting torque from the pulley or sprocket wheel 19*a* to the pulley or sprocket wheel 18*a* includes a gear train 30 the details of which form no part of the invention. All that counts is to ensure that the pulley or sprocket wheel 18*a* is rotated even if it moves up or down against the opposition of or under the action of the biasing means 27.

The shaft 6 of the oscillating means including the rod 8, lever 7 and link 4 is located substantially midway between the upper portions of the walls 1*a* and 3. A projection of this shaft into the plane of the upper reach of the lower conveyor 19 is preferably located in front of the lower portion 13 of the rear wall 3, at least when the wall 3 is held in the solid-line position of FIG. 1.

An important advantage of the improved cutting machine is that the rear wall 3 of the duct 1 performs the aforediscussed oscillatory movements, namely, that the main component of movement of the upper portion 13*a* of the wall 3 is vertical or nearly vertical and that the main component of movement of the lower portion 13 of the wall 3 is horizontal or nearly horizontal. Thus, the extent of the vertical movement of the rear wall 3 gradually decreases and the extent of horizontal movement of the wall 3 gradually increases, as considered in the direction from the open upper portion of the duct 1 toward the zone 16. This causes the upper part of the wall 3 to tamp the incoming fragments 2 in a direction toward and into the lower part of the duct 1 whereas the spade-like lower portion 13 of the wall 3 pushes the descending mass of fragments 2 into the path 10 between the conveyors 18 and 19. It will be noted that the rear portion of the upper reach of the conveyor 19 extends well beyond the rear portion of the lower reach of the conveyor 18, and that the lower portion 13 of the wall 3 reciprocates (arrow 14) at a level above such rear portion of the upper reach of the conveyor 19. The vertical projection of the shaft 6 onto the conveyor 19 is located in the plane of the just discussed rear portion of the upper reach of the conveyor 19. Continuous or frequent tamping of material which enters the duct 1 in a direction toward the conveyor 19 and continuous pushing of the descending material into the path 10 between the conveyors 18, 19 ensures that the cake 22 is free of voids and that the fibrous material is not likely to bridge in the duct 1, in the zone 16 and/or in the path 10 between the conveyors 18 and 19. This, in turn, guarantees predictable operation of the machine, the making of satisfactory shreds, and predictable output of the machine.

The parts 4, 6, 7, 8, 9, 9*a* and 11 constitute but one form of means for oscillating the rear wall 3 in the aforementioned manner, namely, so that the upper portion 13*a* of the wall 3 performs a predominantly vertical and the lower part 13 of the same rear wall performs a predominantly horizontal movement. The oscillating means which is shown in the drawing is preferred at this time because it is simple, compact, rugged and inexpensive. Such oscillating means can comprise two connecting rods 8, two levers 7 and two links 4, one at the rear side and one at the front side of the duct 1, as viewed in the drawing.

The reference character 35 denotes a pneumatic conveyor which serves to remove the shreds 32 from the machine and to transport such shreds to a further processing station, e.g., into a conditioning machine wherein the moisture content of all shreds is uniformized or directly into the magazine of a distributor in a cigarette making machine.

Commonly owned U.S. Pat. No. 4,149,547, granted Apr. 17, 1979 to Werner Komossa et al., discloses a tobacco cutting machine wherein the rear wall of the duct has a lower portion which performs a substantially horizontal movement and an upper portion which pivots about a fixed or practically fixed axis. Therefore, the rear wall cannot perform tamping movements corresponding to movements of the upper portion 13*a* of the rear wall 3 of the present machine.

Another commonly owned U.S. Pat. No. 4,090,521, granted May 23, 1978 to Uwe Elsner, discloses a duct with a rear wall whose upper portion invariably pivots about a fixed axis. Therefore, the rear wall cannot perform any downwardly oriented tamping action and its lower end portion is caused to move back and forth along a distinct arcuate path.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. In a machine for cutting tobacco or similar fibrous material, the combination of a conveyor system defining an elongated substantially horizontal convergent path for the transport of fibrous material in a predetermined direction and including a portion extending rearwardly of and beyond said path; a substantially upright duct having an open upper portion for admission of fibrous material into its interior and an open lower portion disposed above and arranged to discharge fibrous material onto said portion of said conveyor system, said duct having a mobile rear wall having an upper portion in the region of said open upper portion and a lower portion in the region of said open lower portion; and means for oscillating said rear wall with a substantially vertical component of movement in the region of said open upper portion and a substantially horizontal component of movement in the region of said open lower portion of said duct so that the upper portion of said rear wall intermittently advances fibrous material toward said open lower portion and said lower portion of said rear wall intermittently advances fibrous material from said open lower portion, along said portion of said conveyor system and into said path.

2. The combination of claim 1, wherein said oscillating means includes a pivot member disposed in front of said upper portion of said rear wall, as considered in said direction, and means for coupling said upper portion of said rear wall to said pivot member, said pivot member having an axis disposed in a vertical plane which intersects said portion of said conveyor system in front of the lower portion of said rear wall.

3. The combination of claim 1, wherein said lower portion of said rear wall resembles a spade.

4. The combination of claim 1, wherein said oscillating means comprises a substantially horizontal pivot member disposed in the upper portion of said duct and a link pivotable about said member and rigid with the upper portion of said rear wall.

5. The combination of claim 4, wherein said pivot member is disposed substantially centrally of said upper portion of said duct, as considered in said direction.

6. The combination of claim 1, wherein said oscillating means includes a prime mover having a rotary output element, an eccentric secured to said output element, and a linkage coupling said eccentric with the upper portion of said rear wall.

7. The combination of claim 1, wherein the lower portion of said rear wall curves forwardly, as considered in said direction, and constitutes a spade which pushes fibrous material into said path, said horizontal component of movement being substantially parallel to said direction.

8. The combination of claim 1, wherein the width of said duct, as considered in said direction, decreases from the upper toward the lower portion thereof.

9. The combination of claim 1, wherein said conveyor system includes two endless conveyors including an upper conveyor having a lower reach bounding the upper side of said path and a lower conveyor having an upper reach bounding the underside of said path, said upper reach including a section which constitutes said portion of said conveyor system.

10. The combination of claim 9, wherein said path has a discharge end and further comprising means for comminuting fibrous material which advances to the discharge end of said path.

* * * * *